US005733157A

United States Patent [19]

Okuzawa et al.

[11] Patent Number: 5,733,157

[45] Date of Patent: Mar. 31, 1998

[54] FOUR-CYCLE OUTBOARD MOTOR

[75] Inventors: Kazuhiro Okuzawa; Takaji Kawai, both of Hamamatsu, Japan

[73] Assignee: Sanshin Kogyo Kabushiki Kaisha, Hamamatsu, Japan

[21] Appl. No.: 633,203

[22] Filed: Apr. 16, 1996

[30] Foreign Application Priority Data

Apr. 17, 1995 [JP] Japan ..... 7-115108

[51] Int. Cl.[6] ..... B63H 21/32

[52] U.S. Cl. ..... 440/89; 123/195 P

[58] Field of Search ..... 440/88, 89, 900; 123/195 P; 60/310; 181/251, 260

[56] References Cited

U.S. PATENT DOCUMENTS 5,232,387 8/1993 Sumigawa ..... 440/89

*Primary Examiner*—Jesus D. Sotelo

*Attorney, Agent, or Firm*—Knobbe, Martens, Olson & Bear LLP

[57] ABSTRACT

Embodiments of four-cycle outboard motors having an improved exhaust system. The exhaust system includes an expansion chamber that is formed in the drive shaft housing of the outboard motor below an oil tank for the engine which is positioned therein. A water chamber is formed around the expansion chamber and the lower portion of the oil tank for cooling them. An above-the-water exhaust gas discharge is provided that communicates with the area above the water jacket.

21 Claims, 11 Drawing Sheets

FOUR-CYCLE OUTBOARD MOTOR

BACKGROUND OF THE INVENTION

This invention relates to a four-cycle outboard motor and more particularly to an improved exhaust and lubricant system for such an outboard motor.

For a wide variety of reasons, it has been proposed to substitute four-cycle internal combustion engines for the more normally used two-cycle power plant in outboard motors. These engines have certain advantages over two-cycle engines but also have some disadvantages which have previously limited their applicability to outboard motors. The basic advantage of a two-cycle engine in outboard motors is its simplicity, which is particularly important in conjunction with an outboard motor where space is at the premium. However and as has been noted, there is a renewed interest in the applicability of four-cycle engines to outboard motors.

With a four-cycle engine unlike a two-cycle engine, the lubricant is recirculated through the engine for its lubrication. This generally requires a lubricant tank or oil sump for the engine that can be position in proximity to the engine. If the oil tank is positioned below the engine in the power head, then the center of gravity becomes too high and rearward vision is obstructed.

It has, therefore, been the practice and proposal to position the oil tank for the engine in the drive shaft housing of the outboard motor. This faces the oil tank below the engine and out of the power head. There are, however, certain difficulties with this positioning of the oil tank. These have to do with factors dealing with the treatment of the exhaust gases exiting the engine and also the manner in which lubricant is circulated between the engine and the oil tank.

As with many other facets of outboard motor design, the exhaust system for the engine presents significant design problems. Unlike other engine applications wherein relatively long exhaust systems can be employed, outboard motors are very compact and the exhaust system is quite short in length. In addition, the space available for various conventionally used tuning and/or silencing devices in other applications is not available.

Therefore, it has been proposed to discharge the exhaust gases, under at least most running conditions, through an underwater exhaust gas discharge. By so discharging the exhaust gases, the body of water in which the outboard motor is operating can be utilized as a silencing device. However, this means that the exhaust gases must be transmitted through the drive shaft housing to the atmosphere. It has also been the practice to use silencing devices in the drive shaft housing such as one or more expansion chambers so as to assist in the exhaust treatment. When, however, the oil tank for the engine is also positioned in the drive shaft housing, then space requirements become a problem.

In addition to finding the requisite space for both the exhaust system and the oil tank there is the concern of heat transfer between the exhaust system and the oil tank and the oil therein. As has been noted, it has been the practice to utilize an expansion chamber in the drive shaft housing for exhaust silencing purposes and this generally is provided in the same area where the oil tank is positioned. Although it has been proposed to position the oil tank so that it depends into the expansion chamber, this increases the area of heat transfer between the oil tank and the expansion chamber.

Although it has also been proposed to position the expansion chamber below the oil tank, it is still necessary to deliver the exhaust gases from the power head to the expansion chamber. Generally, this has been done by passing an exhaust pipe through the center of the oil tank and thus heat transfer problems still are present.

It is, therefore, a principal object of this invention to provide an improved arrangement for treating the exhaust gases and containing the oil for a four-cycle outboard motor.

It is a further object of this invention to provide an improved drive shaft housing arrangement for an outboard motor that will accommodate an oil tank and an expansion chamber and provide good heat insulation and cooling for these components.

It is a still further object of this invention to provide an improved drive shaft housing arrangement for an outboard motor including an oil tank and an expansion chamber and wherein a cooling jacket can be provided for them and the overall construction still simplified.

Although the use of underwater exhaust gas systems are effective in providing silencing, these exhaust systems are generally practical only when operating under high-speed/high-load conditions. Under these conditions, the exhaust gas pressures are quite high as is the volume of exhaust gas flow. In addition, because of the planing condition of the associated watercraft, the underwater discharge is not very deeply submerged. However, when the watercraft is traveling at a low-speed, both the exhaust pressure and volume is low and the degree of submersion of the underwater exhaust gas discharge is high. This adversely effects engine performance.

Therefore, it has been proposed to utilize above-the-water exhaust gas discharges for outboard motors to relieve the back pressure when operating under these low-speed conditions. The above-the-water discharge systems, however, also require some silencing. This is particularly true since the discharge of the exhaust gases is above rather than below the water level. All of these problems are further complicated in conjunction with four-cycle outboard motors because of the aforenoted positioning of the oil tank.

It is, therefore, a still further object of this invention to provide an improved exhaust system for an outboard motor wherein an above-the-water discharge system can be employed for low-speed running and yet the heat from these low-speed exhaust gases are well insulated from the oil tank.

SUMMARY OF THE INVENTION

A first feature of this invention is adapted to be embodied in a four-cycle outboard motor having a power head comprised of a four-cycle internal combustion engine and a surrounding protective cowling. A drive shaft housing depends from the power head and is comprised primarily of an outer casing. A support plate spans the upper end of the drive shaft housing outer casing and supports the engine. An oil tank for the engine depends into the drive shaft housing outer casing and contains oil for the engine. A main exhaust expansion chamber is also formed in the drive shaft housing in substantial part below the oil tank. A casing surrounds the oil tank and the main expansion chamber and forms a water jacket at least in part therein. Means are provided for delivering cooling water to this water jacket. The engine is further provided with an exhaust system which includes means for delivering exhaust gases to the main expansion chamber. This main expansion chamber communicates with a high-speed underwater exhaust gas discharge formed within the drive shaft housing at a lower portion thereof. A sub-expansion chamber is provided in an upper portion of the water storage chamber and also communicates with the exhaust gases of the engine. This sub-expansion chamber discharges to the atmosphere through and above the water exhaust port formed at a point well above the water level during all engine operating conditions.

Another feature of the invention is adapted to be in a four-cycle outboard motor which also has a power head containing a powering four-cycle internal combustion engine and a surrounding protective cowling. A drive shaft housing depends from this power head and contains an oil tank for the engine in an upper area thereof. An exhaust pipe depends into the drive shaft housing from the engine and conveys exhaust gases to an expansion chamber provided in the drive shaft housing below the oil tank. The exhaust pipe has a portion that is at least in part confronting relation to a portion of the oil tank. An idle exhaust hole is provided in this upper portion of the exhaust pipe. A shield is interposed between this idle exhaust hole and the oil tank portion so that the exhaust gases are not directly discharged against the oil tank portion.

DETAILED DESCRIPTION OF THE PREFERRED EMBODIMENTS OF THE INVENTION

Figure 1:
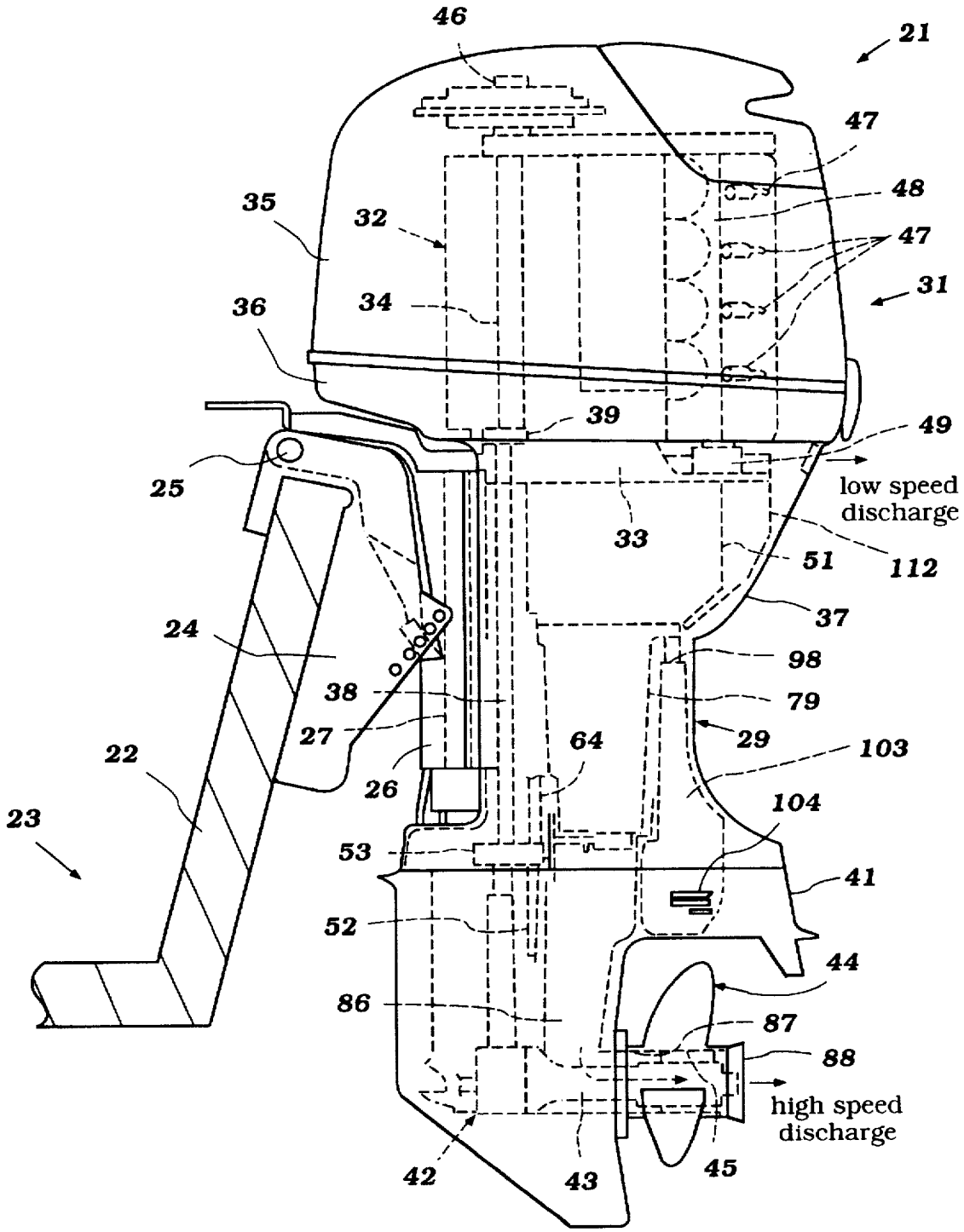
FIG. 1 is a side elevational view of an outboard motor constructed in accordance with a first embodiment of the invention, as shown attached to the transom of an associated watercraft which is shown partially and in cross section.

Referring now in detail to the drawings and initially to FIGS. 1–10, an outboard motor constructed in accordance with this embodiment is identified generally by the reference numeral 21. As may be best seen by first reference to FIG. 1, the outboard motor 21 is adapted to be detachably affixed to a transom 22 of a watercraft, shown partially in cross section and identified generally by the reference numeral 23.

The outboard motor 21 includes a clamping bracket 24 that is detachably connected to the transom 22 in any manner known in this art. The clamping bracket 24 carries a tilt pivot pin 25 upon which a swivel bracket 26 is pivotally supported. This pivotal movement about the pivot pin 25 accommodates tilt and trim movement of the outboard motor 21.

The swivel bracket 26, in turn, rotatably journals a steering shaft 27 for steering of the outboard motor 21 about a vertically extending axis. The steering shaft 21 is connected by means including a connector assembly 28 (FIGS. 2 and 5) to a drive shaft housing assembly, indicated generally by the reference numeral 29 in a well known manner.

A power head, indicated generally by the reference numeral 31 is positioned at the upper end of the drive shaft housing 29. This power head includes an internal combustion engine, indicated generally by the reference numeral 32 and which is, in the illustrated embodiment, depicted as being of a four-cylinder, in-line, four-cycle engine. The engine 32 is mounted in the power head 31 upon a support plate 33 in a manner so that its crankshaft 34 rotates about a vertically extending axis.

The power head 31 is completed by means of a protective cowling that is comprised of an upper main cowling portion 35 and a lower tray portion 36. The tray portion 36 has a lower shroud 37 which in part encircles the upper end of the drive shaft housing 29.

The vertical positioning of the engine crankshaft 34 facilitates its coupling to a drive shaft 38 by a coupling member 39. The drive shah 38 depends into the drive shaft housing 29 and continues on to a lower unit 41 which forms a continuation of the drive shaft housing 29. A conventional forward, neutral, reverse transmission 42 is provided in the lower unit 41 and is driven by the drive shaft 38. This transmission 42 permits a propeller shaft 43, which is also journaled in the lower unit 41, to be driven in selected forward or reverse directions. In addition, a neutral condition is provided wherein the engine crankshaft 34 and drive shaft 38 may rotate without driving the propeller shaft 43. A propeller 44 is connected by means of an elastic coupling 45 to the propeller shaft 43 for propelling the associated watercraft 23 in a well-known manner.

Still continuing to refer primarily to FIG. 1, the engine 32 can have any generally conventional type of construction but, as has been noted, the invention has particular utility in conjunction with four-cycle engines and the engine 32 is of this type. A flywheel magneto 46 is driven off the upper end of the crankshaft 34 and supplies electrical power for, among other things, firing of spark plugs 47 that are mounted in a cylinder head 48 of the engine 32.

The engine 32 also is provided with a single overhead cam shaft and an oil pump 49 is driven off the lower end of this cam shaft for circulating oil through the engine from a lubricant tank, indicated generally by the reference numeral 51 and which is positioned in the upper portion of the drive shaft housing 29 in a manner which will be described. Oil is returned to this oil tank 51 also in a manner which will be described.

The engine 32 is also water cooled and water for engine cooling is drawn from the body of water in which the watercraft is operating through a water inlet pipe 52 that communicates with an opening (not shown) in the lower unit 41. A water pump 53 is driven off the drive shaft 38 at the interface between the lower unit 41 and the main portion of the drive shaft housing 29 in a known manner. This water is then delivered to the engine 32 and specifically its cooling jacket in a manner which will be described.

As should be readily apparent from the foregoing description, the invention deals primarily with the fluid handling system for the engine 32 and specifically the lubrication system, the cooperation of the cooling system with it and the exhaust system for the engine and its discharge to the atmosphere. Therefore, the foregoing description of the engine 32 and the other components of the outboard motor 21 have been relatively general in nature. The facets dealing with the aforenoted features will now be described by particular reference to the remaining figures. Thus, where any components of the engine 32 or outboard motor 21 have not been described or illustrated, they may be considered to be conventional. Those skilled in the art will readily understand how the invention can be practiced with such conventional features from the following description.

The oil tank 51 and its relationship to certain other components of the engine 32 and outboard motor 21 will now be described by primary reference to FIGS. 2–4. It should be noted that the oil tank 51 is affixed in a suitable manner to the underside of the support plate 33. The oil tank 51 defines an internal volume indicated by the reference character A. As may be seen in several of the figures, the oil tank 51 is provided with a central opening 54 for a purpose which will be described. Thus, the oil tank 51 has a generally annular configuration. A strainer assembly 55 is provided at the lower end of an oil pickup tube 56. The oil pickup tube 56 cooperates with a delivery passage 57 formed in the mounting plate 33 and functions so as to deliver lubricant to the oil pump 49 through appropriate passages. The oil pump 49 discharges to a discharge circuit which includes a return line that leads to a pressure relief valve 58. The pressure relief valve 58 serves to limit maximum pressure in the lubricating system of the engine by dumping excess oil back to the oil tank 51. The upper portion of the oil tank 51 and specifically the relief valve 58 is formed in a mounting plate portion 60 that is affixed to the underside of the mounting plate 53 by threaded fasteners 59.

A drain plug 61 is provided in a lower peripheral edge of the oil tank 51 adjacent the tray shroud portion 37. This drain plug may be accessed through an access opening 62 formed by a sleeve 63 that is fixed to the tray shroud portion 37 so that the lubricant for the engine can be drained without necessitating removal of any of the major components of the outboard motor.

Figure 2:
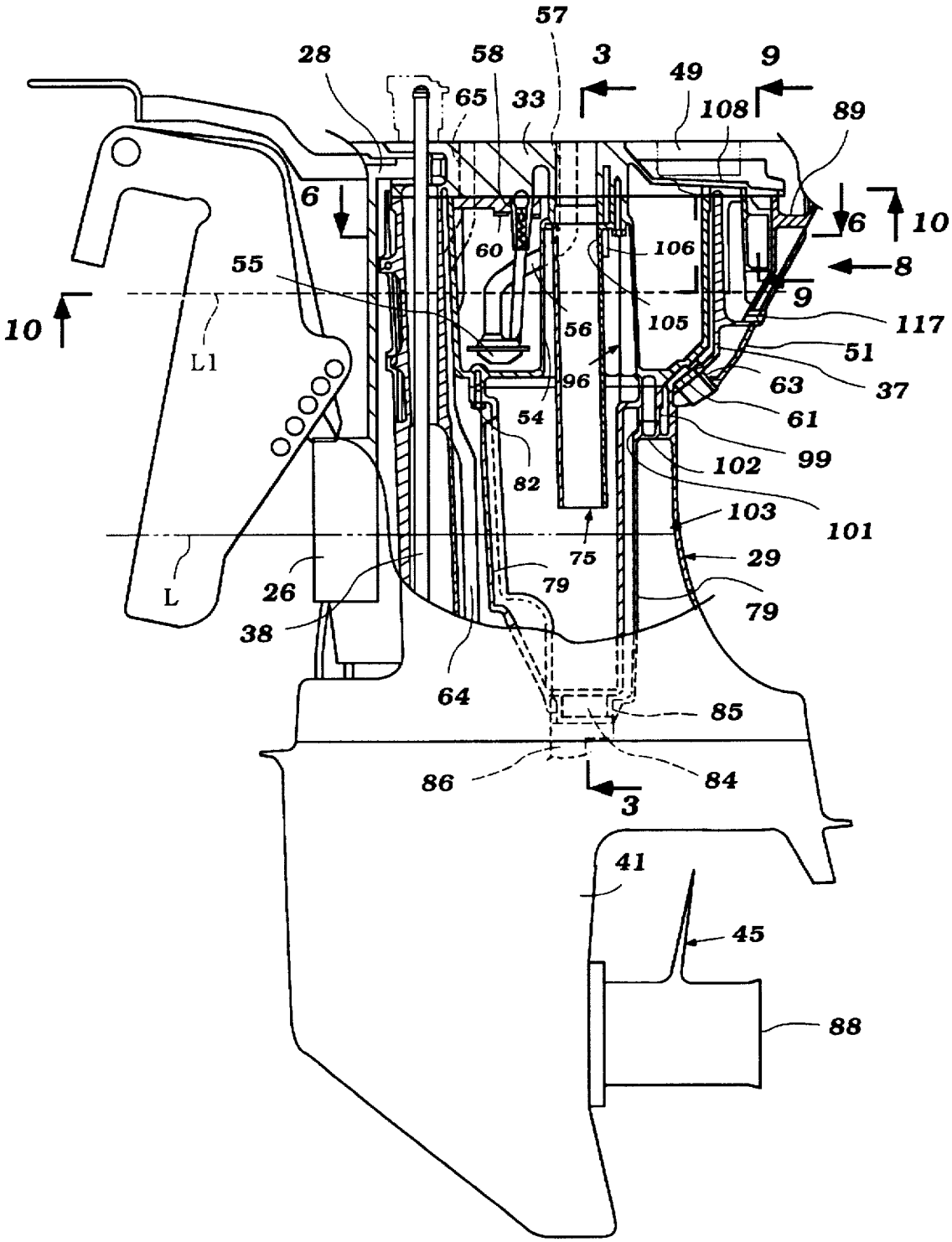
FIG. 2 is an enlarged view looking in the same direction as FIG. 2 and shows the upper portion of the drive shaft housing broken away, other portions shown in section and the power head removed.
Figure 3:
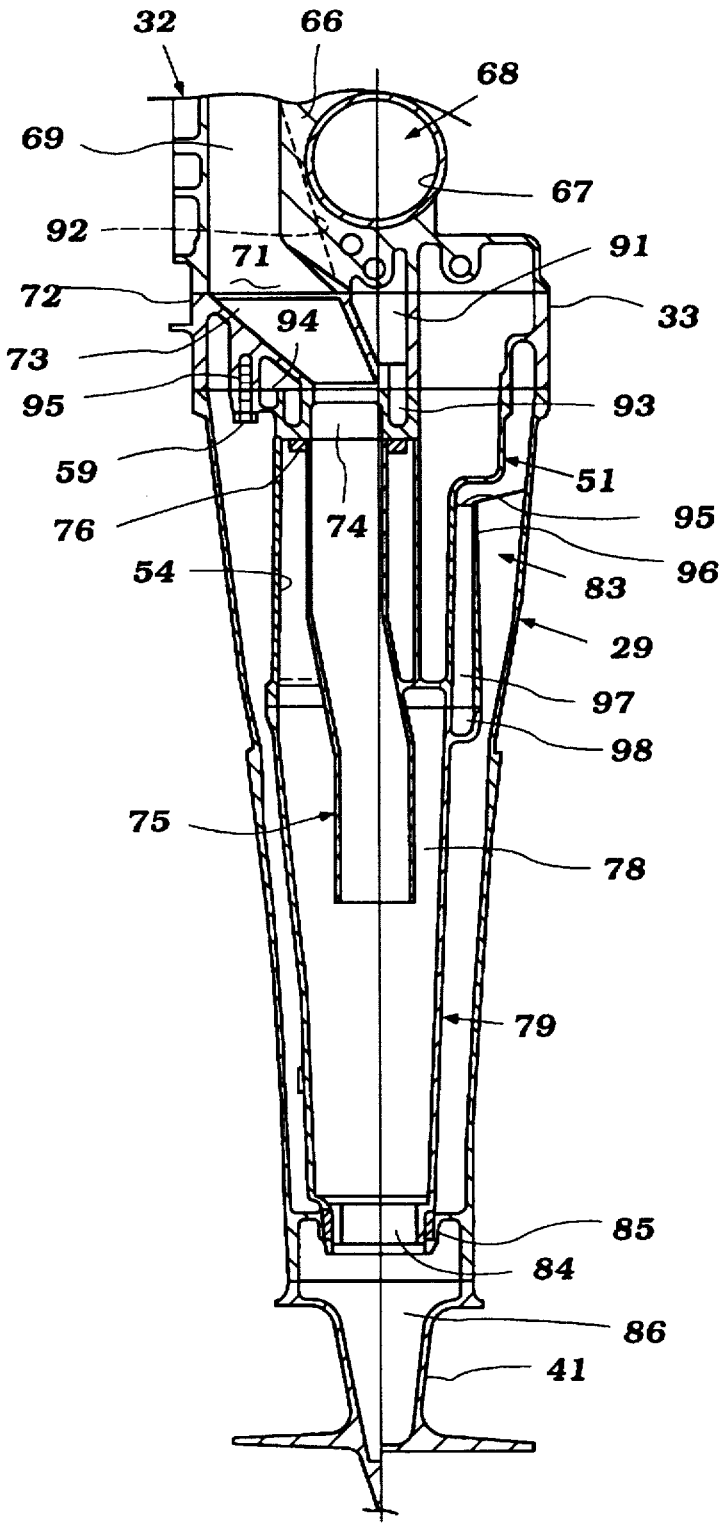
FIG. 3 is a cross-sectional view taken along the line 3—3 of FIG. 2 and is further enlarged.
Figure 4:
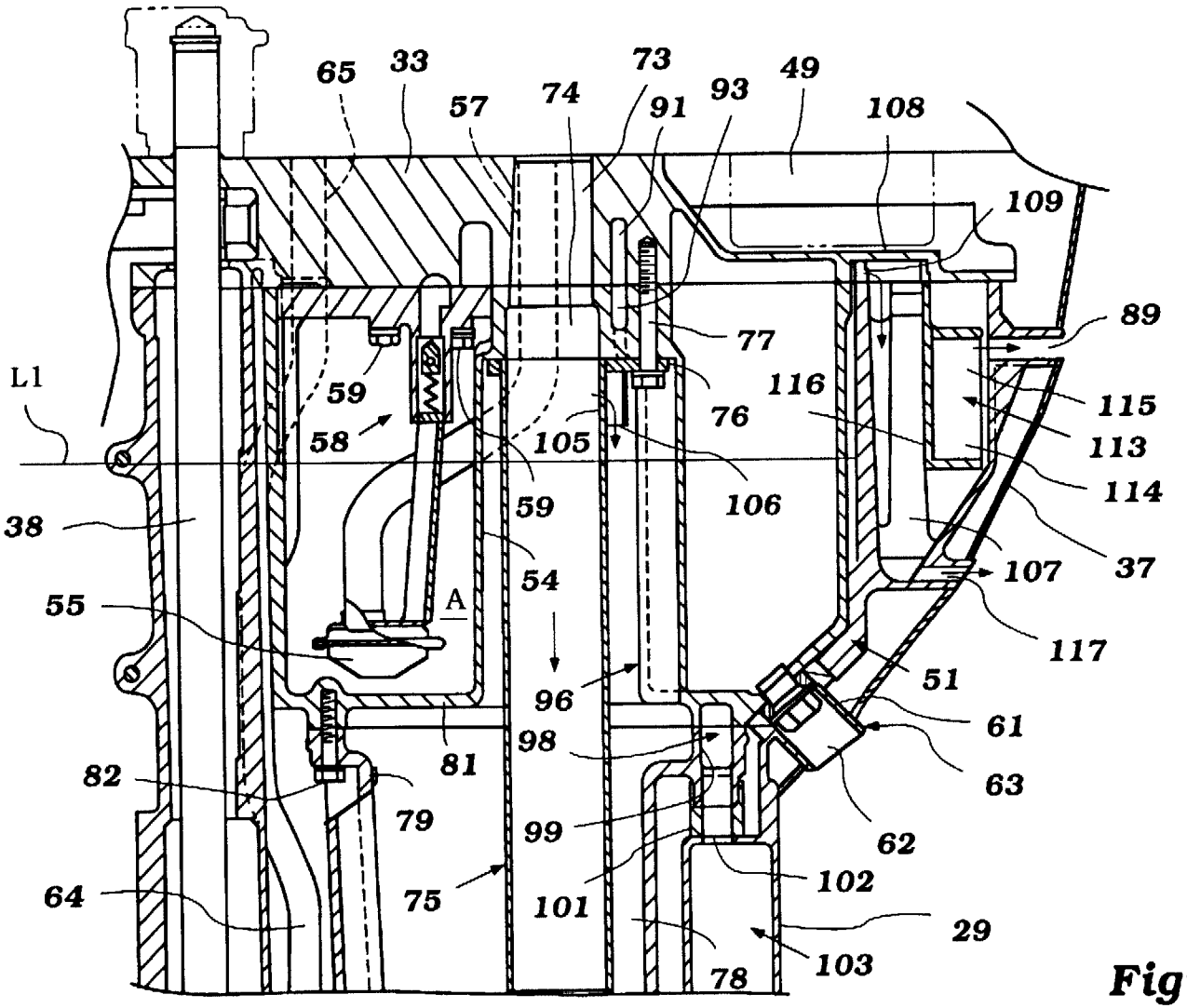
FIG. 4 is a still further enlarged cross-sectional view looking in the same direction and showing the same components as are broken away in FIG. 2.

Before leaving the description of FIGS. 2–4 to progress to the description of the exhaust system, it should be noted that these figures illustrate the water delivery pipe 64 that extends upwardly from the water pump 53 and which delivers water to the engine cooling jacket through a water fitting 65 which is formed in the support plate 33. The return path for this water will also be described later.

Turning now to the exhaust system, this system will be described by most particular reference to FIGS. 2–4, 6 and 7. Although the basic internal details of the engine 32 are not necessary to understand the invention, some description of the exhaust manifolding of the engine 32 will be helpful to permit those skilled in the art to understand how to practice the invention.

As may be seen in the upper portion of FIG. 3, the engine 32 includes in addition to the cylinder head 48 a cylinder block 66 in which the cylinder bores 67 of the engine are formed. As has been noted, in the illustrated embodiment, the engine 32 is of the four-cylinder, in-line type and hence FIG. 3 shows the lowermost cylinder bore 67. A piston 68 reciprocates in this cylinder bore 67 and drives the crankshaft 34 in a well known manner.

The cylinder head 48 is formed with an exhaust manifold which conveys the exhaust gases to a collector section 69 that is formed in the cylinder block 66 and which has a discharge end 71 in a lower face 72 of the cylinder block 66. This discharge opening 71 communicates with an exhaust passage 73 that is formed in the support plate 33. This exhaust passage 73 communicates with a further exhaust passageway 74 that is formed in the aforenoted oil tank cover plate 60.

An exhaust pipe 75 is affixed to this cover plate 60 by means of a flange 76 and threaded fasteners 77. The exhaust pipe 75 has a diameter which is smaller than the diameter of the opening 54 in the oil tank 51 so that the exhaust pipe 75 extends therethrough with a clearance. This clearance is as helpful in assisting in ensuring against excess heat transfer between the exhaust system and the lubricating system.

The exhaust pipe 75 extends downwardly into an expansion chamber 78 which is formed by an inner shell member 79 that is affixed to a lower wall 81 of the oil tank 51 by threaded fasteners 82. This expansion chamber forming member or shell 79 in effect forms a continuation of the surface formed by the oil tank 51 and is spaced inwardly from the outer casing of the drive shaft housing 29 so as to form a gap 83 therebetween. This gap 83 further assists in cooling and isolating the heat from the exhaust gases from the outer drive shaft housing 29 in a manner as will be described. When the exhaust gases exit the exhaust pipe 75 into the expansion chamber 78 they will expand and this expansion thus causes silencing of the exhaust gases.

The expansion chamber forming shell 79 is formed with a high-speed exhaust gas discharge opening 84 at the lower end thereof. This opening 84 is formed by a neck around which a sealing gasket 85 is provided. This causes the exhaust gases from the expansion chamber 78 to constrict and flow through the discharge opening 84 into a further expansion chamber 86 that is formed in part in the lower unit 41. Hence, there will be a further contraction and expansion of the exhaust gases which aids in silencing.

As may be best seen in FIG. 1, the lower unit expansion chamber 86 communicates with an annular passage 87 that is formed in the hub of the propeller 44 and which terminates in a rearwardly facing underwater high-speed exhaust gas discharge opening 88. Hence, the exhaust gases from the engine will, under high-speed running conditions exit through the propeller hub discharge 88 and be silenced by the water.

When the watercraft 23 is being propelled at a slower speed, the exhaust gas pressure will be lower and the depth of the high-speed discharge 88 will also fall from the normal relatively low level to a higher level as shown by the line L in FIG. 2. Under this condition, the back pressure is too high at the discharge 88 and the engine would not be able to run unless another exhaust gas path were provided. Therefore, the outboard motor 21 is provided with an above-the-water low-speed exhaust gas discharge system which will be described later. However, this discharge system includes a discharge outlet 89 which is provided in the area of the tray shroud portion 37, as will be described.

It has been noted that the area around the outer surface of the oil tank 51 and the expansion chamber 79 provides a void area 83. In accordance with a feature of the invention, this area is filled to a level L1 with cooling water from the engine's cooling system. This will maintain a lower temperature not only for the exhaust gases but cool the oil tank 51. This cooling system also appeared best in FIGS. 2–4 and will be described by particular reference thereto.

As may be seen in FIG. 3, the support plate 33 is provided with a cooling jacket portion 91 which receives coolant from the engine cooling jacket, which appears partially in this figure and is identified by the reference numeral 92. Water from the engine cooling jacket 92 is discharged into the support plate cooling jacket 93. This water can further collect in a cooling well 93 which is formed in the plate 60 around the exhaust passage 74. This water then overflows a weir 94 so as to flow through a passageway 95 into the cavity 83.

This will cause the water to fill the cavity 83 and substantially completely encircle the expansion chamber 79 and also at least the lower portion of the oil tank 51. The level of water in the chamber 83 is maintained at the level L by means of a further weir 95 that is formed in a channel wall 96 of the oil tank 51 and which defines a flow channel 97. This flow channel 97 communicates at its lower end with a water return path 98 (FIG. 4) that is formed in part by the oil tank shell 51 and the expansion chamber shell 79. This water return path 98 continues on to a discharge port 99 or discharge nipple. This discharge nipple receives a seal 101 which then passes water to a discharge path 102 of a water discharge channel 103 that is formed in the lower portion of the drive shaft housing 29 and the upper portion of the lower unit 41 as best seen in FIG. 1.

The lower unit outer casing 41 is provided with a water discharge opening 104 through which the cooling water from the engine can be discharged back into the body of water in which the watercraft is operating. Therefore, the cooling water from the engine is employed so as to cool the exhaust gases and minimize the heat transfer from the exhaust gases to the lubricating system with minimum water contact with the outer surface of the oil tank 51. This will reduce the likelihood of corrosive deposits building up on the oil tank outer wall.

As has been previously noted, when the outboard motor 21 is running at a low speed and the watercraft 23 is not in a planing condition or is stationary, the water level raises to the point L and the underwater exhaust gas discharge will be too deeply submerged to permit effective exhaust gas discharge. Therefore, there is provided the aforenoted above-the-water, low-speed, exhaust gas discharge 89.

Figure 6:
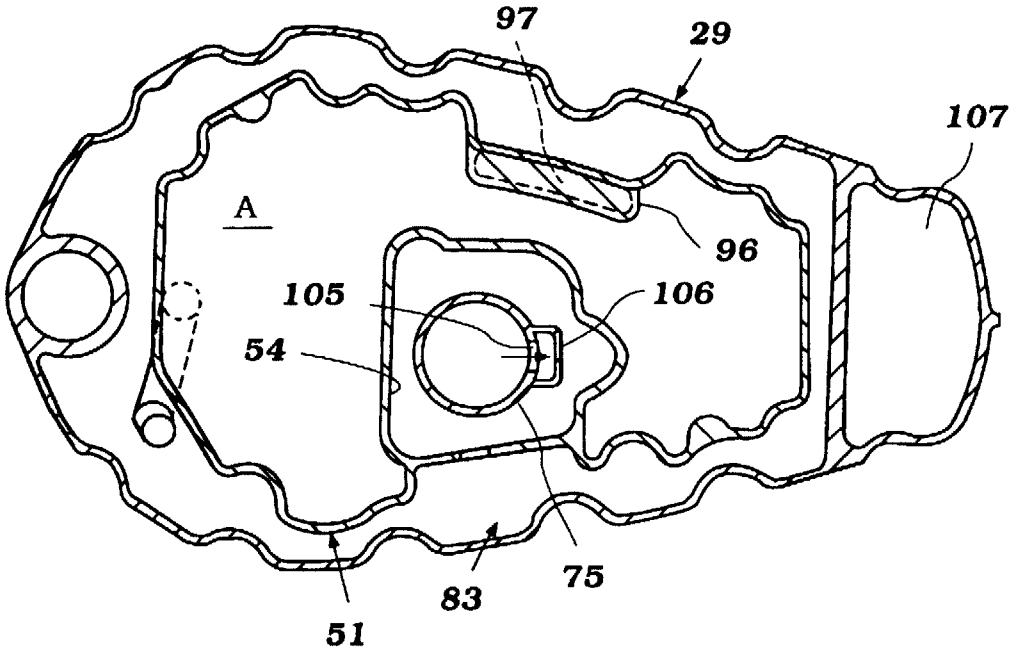
FIG. 6 is an enlarged cross-sectional view taken along the lines 6—6 of FIG. 2.
Figure 7:
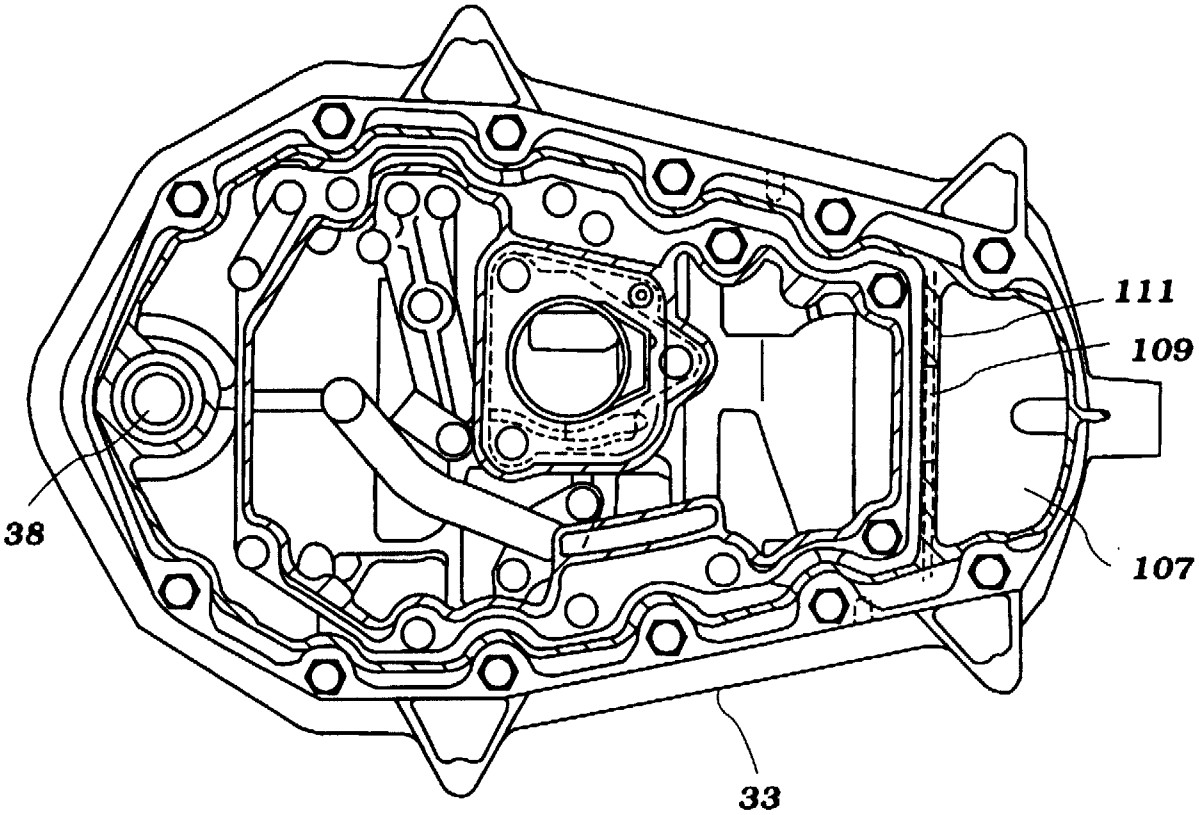
FIG. 7 is a view looking upwardly at the spacer plate on an enlarged scale.

The construction by which exhaust gasses are delivered to this passage 89 will now be described by primary reference to FIGS. 2, 4, and 6–9. Referring first primarily to FIGS. 2, 4, and 6, it will be seen that the exhaust pipe 75 has a low-speed exhaust gas discharge opening 105 formed at an upper area therein which is above the water jacket level L1 in the water jacket 83. This discharge opening 105 is immediately below the exhaust inlet opening 74 which communicates with the spacer plate exhaust discharge passage 73. This low-speed exhaust discharge opening 105 is, in registry with the air gap between the outer surface of the exhaust pipe 75 and the inner surface of the oil tank 54. So as to prevent the exhaust gases from impinging directly on the confronting oil tank inner surface 54, there is provided a baffle plate 106 that is disposed in facing relationship with the opening 105 and which causes the exhaust gases flowing through the opening 105 to be deflected downwardly as shown by the arrow in FIGS. 2 and 4. The exhaust gases will be turned down toward the water level L1 in the cooling jacket 83 and forced to flow therearound to enter a low-speed exhaust gas expansion chamber 107 that is formed in the rear portion of the upper part of the drive shaft housing 29. This exhaust gas expansion chamber 107 is closed at its upper end by a cover plate 108 so as to confine the exhaust gases to this area and to preclude their flowing back into the power head.

Figure 8:
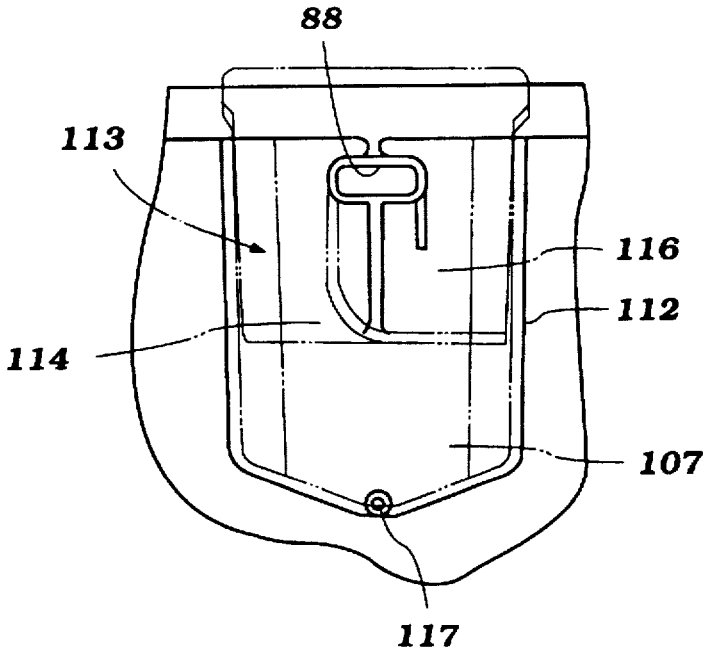
FIG. 8 is a view looking in the direction of the arrow 8 in FIG. 2 and shows the above-the-water low-speed exhaust gas discharge.
Figure 9:
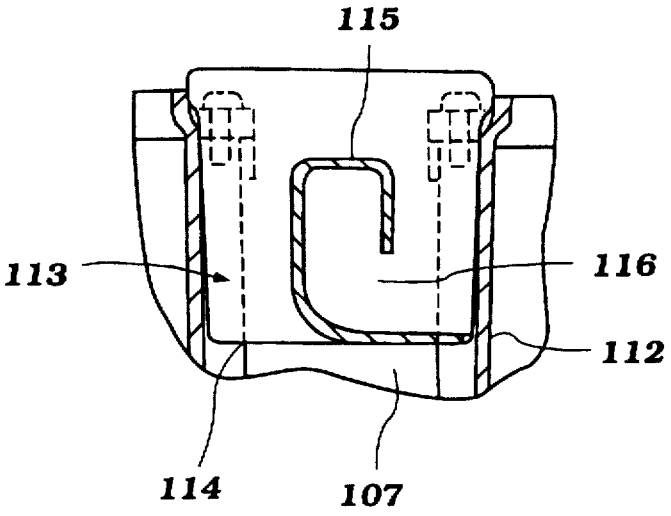
FIG. 9 is a cross-sectional view taken along the line 9—9 of FIG. 8 and is further enlarged, also depicting a portion of the low-speed above-the-water exhaust gas discharge.

These exhaust gases enter this chamber 107 through an opening 109 formed in a dividing wall 111 formed integrally with the drive shaft housing. These exhaust gases then enter a silencing and water separation device that is best shown in FIGS. 8 and 9 and which is formed in part by an embossment 112 formed in the drive shaft housing 29. This separator device is indicated generally by the reference numeral 113 and has an opening area 114 through which the exhaust gases flow upwardly. These exhaust gases are then turned by a baffle wall 115 to flow in a somewhat cylindrical path to a chamber 116.

The chamber 116 communicates directly with the discharge opening 89 which has been afore-referred to and from which the exhaust gases may flow to the atmosphere as shown in FIGS. 1 and 4. A small water drain 117 is provided at the lower part of the chamber 107. Any accumulated water in the exhaust gases will be separated and can drain out of this drain.

Figure 5:
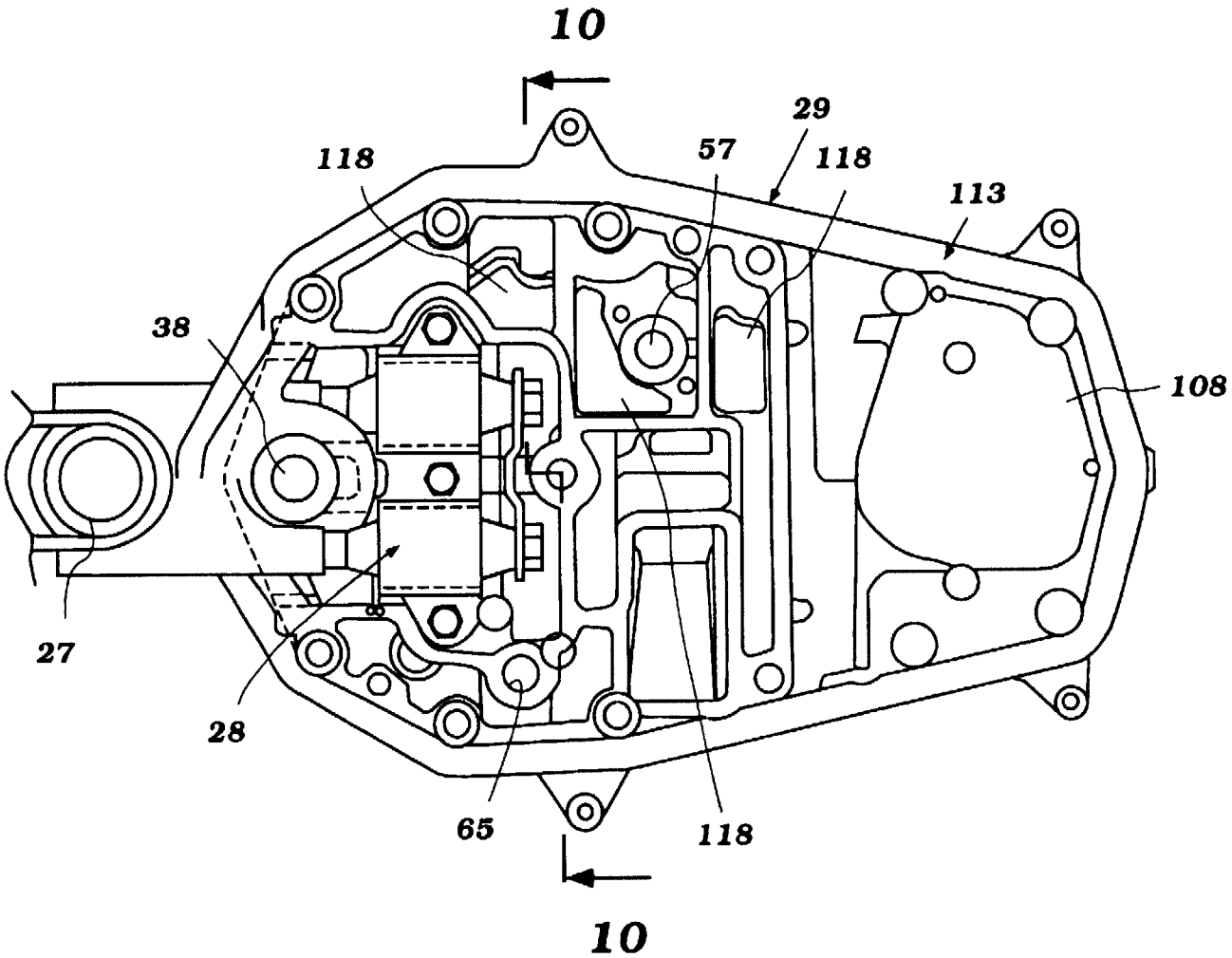
FIG. 5 is a view looking generally down on the drive shaft housing with the spacer plate removed.
Figure 10:
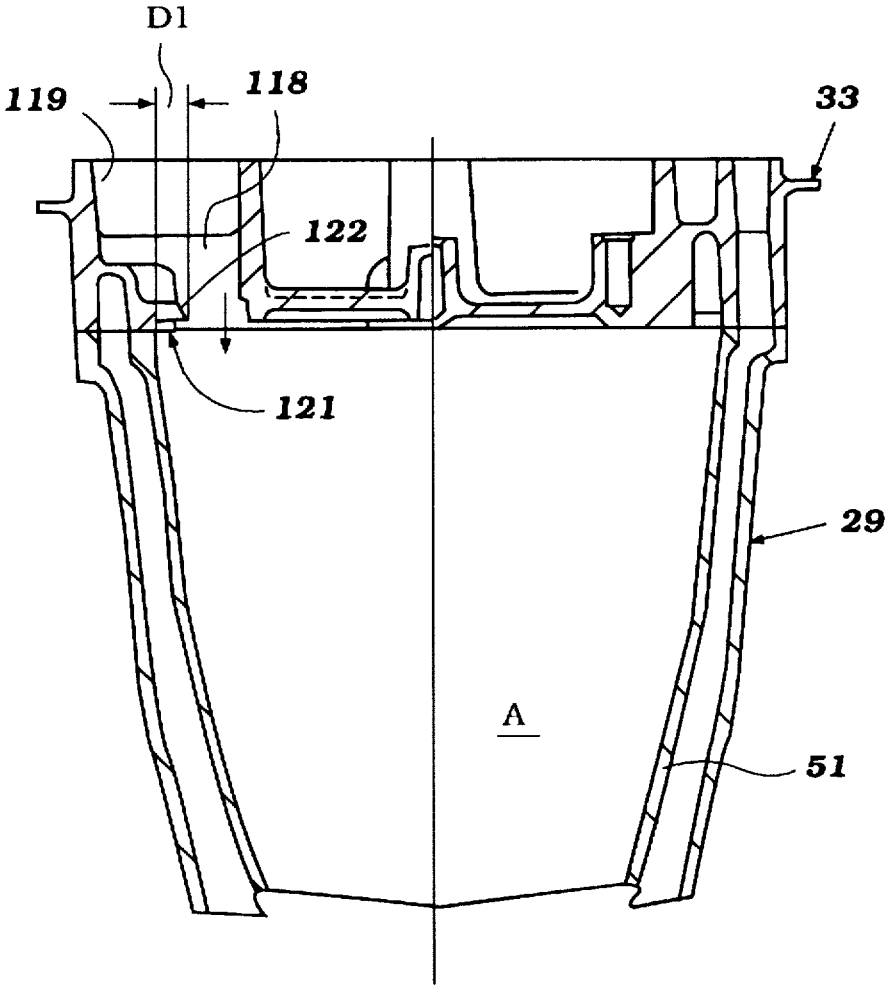
FIG. 10 is an enlarged cross-sectional view taken along the line 10—10 of FIG. 2 and shows the oil return arrangement.

The drain path for returning the oil from the engine lubricating system to the oil tank 51 will now be described by particular reference to FIGS. 5 and 10. It will be seen that the spacer plate 33 is formed with an opening 118 which opens at its lower end into the chamber A of the oil tank 51. There is a well 119 at the upper end of this opening which will receive the lubricant from the engine lubricating system through any suitable drain passages. However, this well 119 and the opening 118 are disposed immediately adjacent the outer periphery of the oil tank.

It is desirable to prevent the lubricant from impinging directly on this surface so as to minimize the heat transfer. Therefore, there is provided a wall-like ledge 121 that extends a distance D1 in from the outer periphery of the inner surface of the oil tank 51. In addition, this ledge has an inclined surface 122 so that lubricant will be channeled toward the center of the oil reservoir A and away from its sides. This ensures that there will be a minimum of heating of the return lubricant and a maximum of mixing of the return lubricant with that in the oil tank so as to facilitate its cooling.

Figure 11:
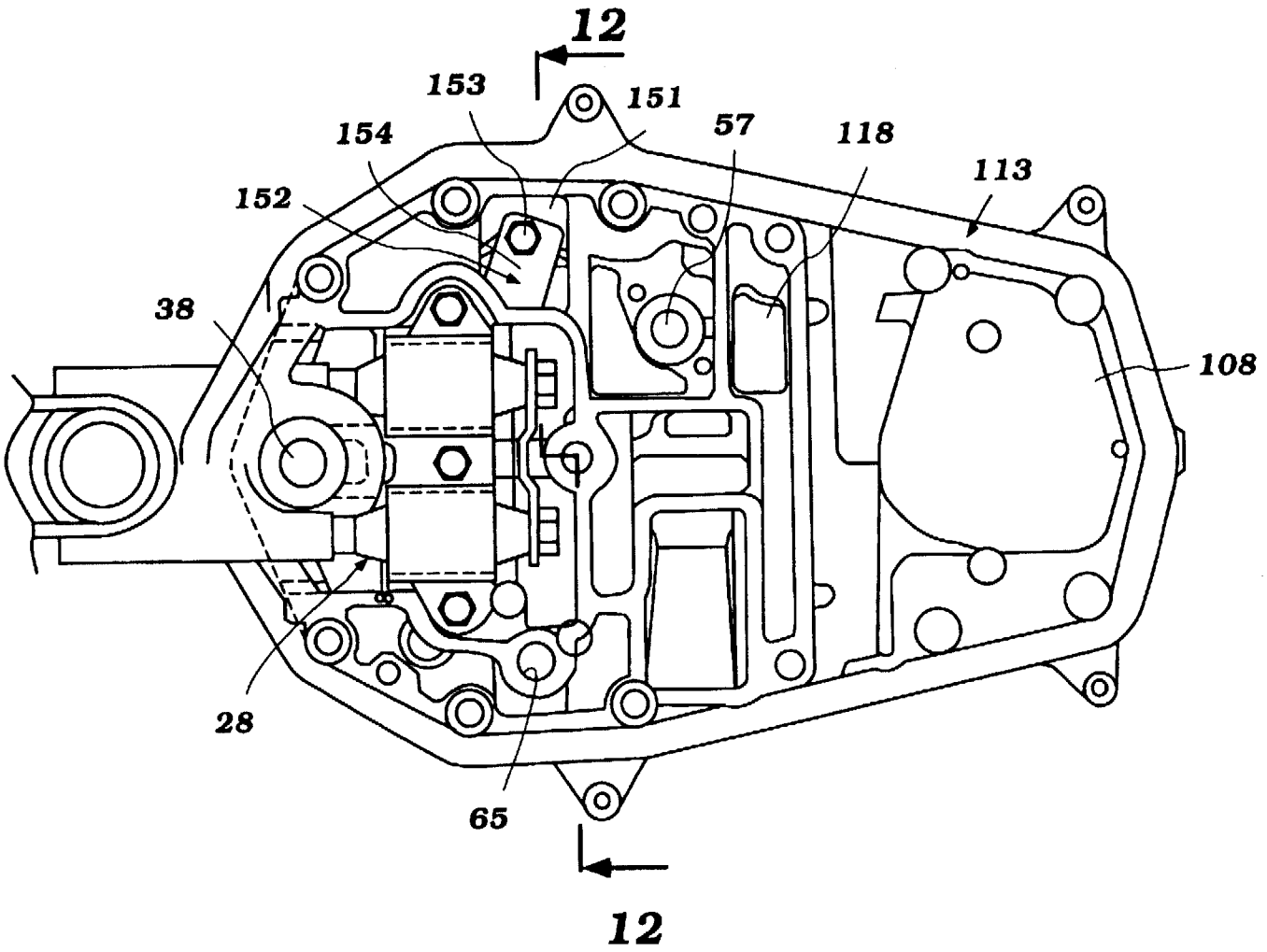
FIG. 11 is a view in part similar to FIG. 5 and shows another embodiment of oil return.
Figure 12:
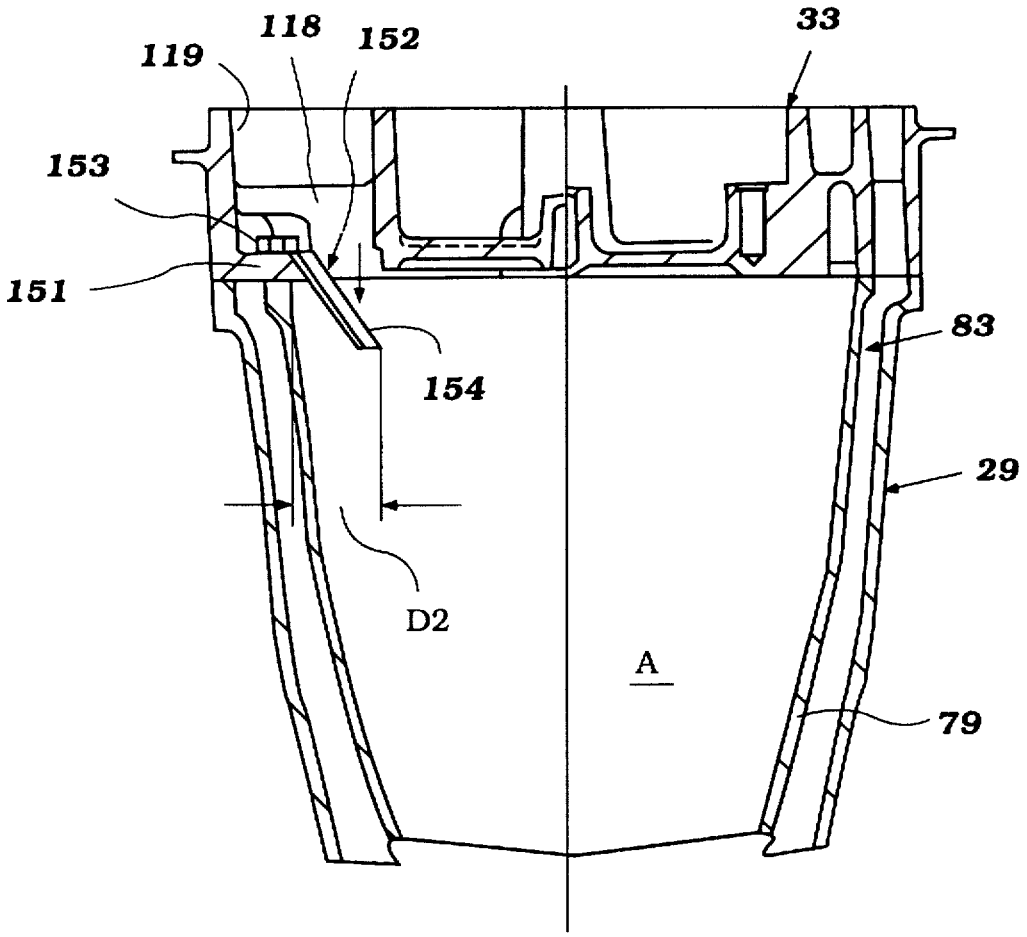
FIG. 12 is a cross-sectional view taken along the line 12—12 of FIG. 11 and is in part similar to FIG. 10.

FIGS. 11 and 12 show another embodiment of the invention which differs from the embodiment already described only in the manner in which the lubricant from the engine is returned from the oil tank 51 and specifically the volume A thereof. FIGS. 11 and 12 may be compared with FIGS. 5 and 10, respectively to show how this embodiment achieves a substantially same result as the previously described embodiment in a different manner. In all other regards, this embodiment is the same as that previously described and, therefore, further description of the remaining portions of the outboard motor are not believed necessary to permit those skilled in the art to practice the invention.

In this embodiment, the opening 118 also has a horizontally-extending wall 151. However, this wall does not extend as far as the wall 121 in the previously-described embodiment. Rather, in this embodiment, a sheet metal baffle 152 is affixed to the wall 151 by a threaded fastener 153. The baffle 152 has an inclined surface 154 that extends across the lower end of the opening 118 and which tapers in toward the center of the oil tank reservoir A a distance D2 which is greater than the distance D1 of the previously described embodiment. As a result, the returning oil will be further reflected in this embodiment toward the center of the oil tank and impingement on the heated outer surfaces will be precluded.

Thus, from the foregoing description, it should be readily apparent to those skilled in the art that the described embodiments of the invention provide a very effective four-cycle outboard motor wherein the lubricant tank for the engine can be provided in the drive shaft housing. This does not interfere, however, with the functioning of the exhaust system nor the expansion chamber. In addition, heat transfer between the exhaust and the lubricant is substantially reduced, the provision of low-speed, above-the-water exhaust gas discharge is facilitated and the oil is returned to the oil tank in such a way that it will not contact any area where the exterior surface of the oil tank may be heated from the exhaust gases.

Those skilled in the art will readily understand that the foregoing description is that of the preferred embodiment of the invention and that various changes and modifications may be made without departing from the spirit and scope of the invention, as defined by the appended claims.

What is claimed is:

1. A four-cycle outboard motor having a power head comprised of a four-cycle internal combustion engine and surrounding protective cowling, a drive shaft housing depending from said power head and comprised of an outer casing, a support plate spanning the upper end of said drive shaft housing outer casing in supporting said engine, an oil tank for said engine depending into said drive shaft housing outer casing and containing oil for said engine, an exhaust expansion chamber for receiving exhaust gases from said engine disposed beneath said oil tank and having an outer wall at least in part coextensive therewith, an exhaust pipe for delivering exhaust gases from the exhaust system of said engine into said expansion chamber, an underwater exhaust gas discharge communicating with the lower end of said expansion chamber for delivering the exhaust gases therefrom to the atmosphere, means providing a water chamber around the outer periphery of said expansion chamber and directly along at least the lower portion of said oil tank for receiving water and cooling said expansion chamber and said oil tank, a low-speed exhaust gas discharge formed in said outer housing at an area above the level of water in said water chamber, and means for delivering the exhaust gases from said engine exhaust system to said low-speed exhaust gas discharge above the water level in said water chamber.

2. A four-cycle outboard motor as set forth in claim 1, wherein the engine is water-cooled and the water for the water chamber is delivered to said water chamber from a cooling jacket of the engine after having circulated through the cooling jacket.

3. A four-cycle outboard motor as set forth in claim 2, wherein the support plate forms an exhaust opening through which the exhaust gases pass from the engine to the exhaust pipe and further including a water jacket formed at least in part in said support plate and encircling said exhaust opening.

4. A four-cycle outboard motor as set forth in claim 3, wherein the water in the water chamber is maintained at a predetermined level by a weir-type overflow device positioned at an upper end of said water chamber.

5. A four-cycle outboard motor as set forth in claim 4, wherein the water overflowing the weir is returned to the body of water in which the watercraft is operating through a passage formed in an integral wall of the oil tank and through which the exhaust gases pass to the expansion chamber.

6. A four-cycle outboard motor as set forth in claim 1, wherein the low speed exhaust gas discharge receives the exhaust gases from a sub-expansion chamber formed in part in the drive shaft housing outer casing and wherein a baffle is provided in said sub-expansion chamber.

7. A four-cycle outboard motor as set forth in claim 6, wherein the baffle provides a circuitous flow path through the sub-expansion chamber and further including a water drain for draining water from said sub-expansion chamber at a lower area therein.

8. A four-cycle outboard motor, having a power head comprised of a four-cycle internal combustion engine and surrounding protective cowling, a drive shaft housing depending from said power head and comprised of an outer casing, a support plate spanning the upper end of said drive shaft housing outer casing in supporting said engine, an oil tank for said engine depending into said drive shaft housing outer casing and containing oil for said engine, an exhaust expansion chamber for receiving exhaust gases from said engine disposed beneath said oil tank and having an outer wall at least in part coextensive therewith, an exhaust pipe for delivering exhaust gases from the exhaust system of said engine into said expansion chamber, an underwater exhaust gas discharge communicating with the lower end of said expansion chamber for delivering the exhaust gases therefrom to the atmosphere, means providing a water chamber around the outer periphery of said expansion chamber and at least the lower portion of said oil tank for receiving water and cooling said expansion chamber, the water in said water chamber being maintained at a predetermined level by a weir-type overflow device positioned at an upper end of said water chamber, a low-speed exhaust gas discharge formed in said outer housing at an area above the level of water in said water chamber, and means for delivering the exhaust gases from said engine exhaust system to said low-speed exhaust gas discharge above the water level in said water chamber.

9. A four-cycle outboard motor as set forth in claim 8, wherein the water overflowing the weir is returned to the body of water in which the watercraft is operating through a passage formed in an integral wall of the oil tank and through which the exhaust gases pass to the expansion chamber.

10. A four-cycle outboard motor having a power head comprised of a four-cycle internal combustion engine and surrounding protective cowling, a drive shaft housing depending from said power head and comprised of an outer casing, a support plate spanning the upper end of said drive shaft housing outer casing in supporting said engine, an oil tank for said engine depending into said drive shaft housing outer casing and containing oil for said engine, an exhaust expansion chamber for receiving exhaust gases from said engine disposed beneath said oil tank and having an outer wall at least in part coextensive therewith, an exhaust pipe for delivering exhaust gases from the exhaust system of said engine into said expansion chamber, from a lower end of said exhaust pipe, an underwater exhaust gas discharge communicating with the lower end of said expansion chamber for delivering the exhaust gases therefrom to the atmosphere, means providing a water chamber around the outer periphery of said expansion chamber and at least the lower portion of said oil tank for receiving water and cooling said expansion chamber, a low-speed exhaust gas discharge formed in said outer housing at an area above the level of water in said water chamber, means for delivering the exhaust gases from said engine exhaust system to said low-speed exhaust gas discharge above the water level in said water chamber including a restricted idle exhaust gas opening in the upper end of the exhaust pipe in confronting relationship to a portion of said oil tank, and a shield interposed between said idle exhaust gas opening and said oil tank portion so that the exhaust gases are not discharged directly against said oil tank portion.

11. A four-cycle outboard motor as set forth in claim 10, wherein the idle exhaust gas opening is disposed above the water level in the water chamber.

12. A four-cycle outboard motor as set forth in claim 11, wherein the low speed exhaust gas discharge receives the exhaust gases from a sub-expansion chamber formed in part in the drive shaft housing outer casing and wherein a baffle is provided in said sub-expansion chamber.

13. A four-cycle outboard motor as set forth in claim 12, wherein the baffle provides a circuitous flow path through the sub-expansion chamber and further including a water drain for draining water from said sub-expansion chamber at a lower area therein.

14. A four-cycle outboard motor comprised of a power head containing a powering four-cycle internal combustion engine and a surrounding protective cowling, a drive shaft housing depending from said power head, an expansion chamber formed in said drive shaft housing, an oil tank for said engine in an upper area of said drive shaft housing, an exhaust pipe depending into said drive shaft housing from said engine and conveying exhaust gases to said expansion chamber, said exhaust pipe having a portion that is at least in part confronting relation to a portion of said oil tank, an idle exhaust hole provided in the upper portion of said exhaust pipe in confronting relation to a portion of said oil tank and a shield interposed between said idle exhaust hole and said oil tank portion so that the exhaust gases are not directly discharged against said oil tank portion.

15. A four-cycle outboard motor as set forth in claim 14, wherein the expansion chamber is formed beneath the oil tank and further including a below the water, low speed exhaust gases discharge communicating said expansion chamber with the atmosphere at a point below the level of water in which the associated watercraft is operating and means for providing a water chamber around the outer periphery of said expansion chamber and at least the lower portion of said oil tank for receiving water and cooling said expansion chamber.

16. A four-cycle outboard motor as set forth in claim 15, wherein the engine is water-cooled and the water for the water chamber is delivered to said water chamber from a cooling jacket of the engine after having circulated through the cooling jacket.

17. A four-cycle outboard motor as set forth in claim 16, wherein the water in the water chamber is maintained at a predetermined level by a weir-type overflow device positioned at an upper end of said water chamber.

18. A four-cycle outboard motor as set forth in claim 17, wherein the water overflowing the weir is returned to the body of water in which the watercraft is operating through a passage formed in an integral wall of the oil tank and through which the exhaust gases pass to the expansion chamber.

19. A four-cycle outboard motor as set forth in claim 16, wherein the support plate forms an exhaust opening through which the exhaust gases pass from the engine to the expansion chamber and further including a water jacket formed at least in part in said support plate and encircling said exhaust opening.

20. A four-cycle outboard motor as set forth in claim 19, wherein the water in the water chamber is maintained at a predetermined level by a weir-type overflow device positioned at an upper end of said water chamber.

21. A four-cycle outboard motor as set forth in claim 20, wherein the water overflowing the weir is returned to the body of water in which the watercraft is operating through a passage formed in an integral wall of the oil tank and through which the exhaust gases pass to the expansion chamber.

* * * * *